United States Patent [19]

Yoshida et al.

[11] Patent Number: 4,611,689

[45] Date of Patent: Sep. 16, 1986

[54] VELOCITY CONTROL APPARATUS FOR ELEVATOR

[75] Inventors: Masayuki Yoshida, Minokamo; Shota Suzuki, Inazawa, both of Japan

[73] Assignee: Mitsubishi Denki Kabushiki Kaisha, Tokyo, Japan

[21] Appl. No.: 639,421

[22] Filed: Aug. 10, 1984

[30] Foreign Application Priority Data

Aug. 19, 1983 [JP] Japan ..... 58-151251

[51] Int. Cl.[4] ..... B66B 1/30

[52] U.S. Cl. ..... 187/29 R

[58] Field of Search ..... 187/29

[56] References Cited

U.S. PATENT DOCUMENTS 4,213,517 7/1980 Ando ..... 187/29

4,319,665 3/1982 Komuro et al. ..... 187/29

4,475,631 10/1984 Nomura ..... 187/29

4,501,343 2/1985 Salihi ..... 187/29

*Primary Examiner*—William M. Shoop, Jr.

*Assistant Examiner*—W. E. Duncanson, Jr.

*Attorney, Agent, or Firm*—Leydig, Voit & Mayer, Ltd.

[57] ABSTRACT

A velocity control apparatus for an elevator wherein an inverter is controlled by a velocity command signal so as to generate a three-phase alternating current of variable voltage and variable frequency, a three-phase induction motor is driven by the three-phase alternating current, a load acting on the three-phase induction motor is detected by a tachometer generator, and a correction circuit is disposed which adjusts the voltage to be produced from the inverter, in accordance with an absolute value signal of a difference between the detected velocity signal of the tachometer generator and the velocity command signal.

10 Claims, 10 Drawing Figures

VELOCITY CONTROL APPARATUS FOR ELEVATOR

BACKGROUND OF THE INVENTION

This invention relates to a velocity control apparatus for an elevator in which an electric motor is controlled by the use of an A.C. power source of variable voltage and variable frequency.

A three-phase induction motor is structurally stout, and has another advantage of easy maintenance. An apparatus in which the three-phase induction motor is energized with an A.C. power source of variable voltage and variable frequency, whereby a velocity control substantially equal to that of a D.C. motor is effected over a wide range, is disclosed in, e.g., the official gazette of Japanese Laid-open Patent Application No. 56-132275.

In this regard, the three-phase induction motor can be expressed by an equivalent circuit shown in FIG. 1. Referring to the figure, numeral 1 generally designates the three-phase induction motor, numerals 11 and 12 terminals which are connected to a power source (not shown), and numeral 13 a primary winding which consists of a reactance component of value $x_1$ and a resistance component of value $r_1$. Numeral 14 designates a secondary winding, which consists of a reactance component of value $x_2$ and a resistance component of value $r_2/s$ which is inversely proportional to a slip s. Shown at numeral 15 is an exciting circuit one end of which is connected between the primary winding 13 and the secondary winding 14.

Now, letting $v_1$ denote a primary voltage applied across the terminals 11 and 12, $w_O$ a primary frequency across them, $i_1$ a primary current flowing through the primary winding 13, $i_g$ an exciting current flowing through the exciting circuit 15, $i_2$ a secondary current flowing through the secondary winding 14, $E_2$ a secondary induced voltage, s the slip, $P_O$ output power, and T a torque, the following equations of relations hold:

$$i_2 = s\,E_2/r_2 \quad (1)$$

$$P_O = i_2^2(1-s)r_2/s = E_2(1-s)i_2 \quad (2)$$

$$K = E_2/W_O \quad (3)$$

$$w = w_O(1-s) \quad (4)$$

$$P_O = K\,w\,i_2 \quad (5)$$

$$T = P_O/w = K\,i_2 \quad (6)$$

It is accordingly understood that, assuming K to be constant, the torque T changes in proportion to the secondary current $i_2$.

On the other hand, the three-phase A.C. power source of variable voltage and variable frequency is usually controlled so that the ratio between the voltage and the frequency may become constant.

$$\text{That is, } V_1/w_O = \text{constant} \quad (7)$$

FIGS. 2 and 3 show a prior-art control apparatus which employs a variable-voltage variable-frequency power source. Referring to the figures, numeral 21 designates a three-phase induction motor which raises and lowers a cage 22. Numeral 23 indicates load detection means for detecting the load of the three-phase induction motor 21, and specifically used here is a tachometer generator which senses the rotational frequency of the induction motor and generates a velocity signal $V_T$. Numeral 24 indicates a velocity command unit which generates a velocity command signal $V_P$, numeral 25 a comparator which compares the velocity command signal $V_P$ and the velocity signal $V_T$ so as to provide the difference signal $V_S$ between them, numeral 26 an adder which adds the difference signal $V_S$ and the velocuty signal $V_T$, numeral 27 a function generator which generates a frequency command signal F corresponding to the added result of the adder and also generates a voltage command signal V so as to have the relation of a straight line (a) shown in FIG. 3 as a function of the frequency command signal F, numeral 28 a reference sinusoidal wave generator which issues a command on the basis of the frequency command signal F and the velocity command signal V so that a three-phase alternating current of sinusoidal wave may be provided, and numeral 29 an inverter which supplies a three-phase alternating current of variable voltage and variable frequency on the basis of the command of the reference sinusoidal wave generator 28.

In the control apparatus of the above arrangement, when the velocity command signal $V_P$ is generated by the velocity command unit 24, the function generator 27 is fed with the signal through the comparator 25 as well as the adder 26, to deliver the frequency command signal F and the voltage command signal V. These signals change the primary voltage $V_1$ and primary frequency $w_O$ of the three-phase induction motor 21 which are the output voltage and frequency of the inverter 29, respectively, as indicated by the straight line (a) in FIG. 3. That is, the primary voltage $V_1$ is set at a value $V_O$ when the primary frequency $w_O$ is zero, whereupon it is rectilinearly increased with the increase in the primary frequency $w_O$. The three-phase induction motor 21 increases or decreases its rotational frequency in accordance with the primary frequency $w_O$.

When the three-phase induction motor 21 is subjected to a heavy load, the primary current $i_1$ increases. As a result, a voltage drop across the primary winding 13 increases to lower the secondary induced voltage $E_2$. The relation between the secondary induced voltage $E_2$ and the primary frequency $w_O$ on this occasion becomes as indicated by a straight line (b) in FIG. 3, the gradient of which is smaller than that of the straight line (a). On the other hand, in case of a light load, the primary current $i_1$ has a small value, so that the voltage drop across the primary winding 13 is small, and the secondary induced voltage $E_2$ becomes a value close to the primary voltage $V_1$. The relation between the secondary induced voltage $E_2$ and the primary frequency $w_O$ on this occasion becomes as indicated by a straight line (c) in FIG. 3, the gradient of which is somewhat smaller than that of the straight line (a).

Thus, in the case of the heavy load, the decrease of the constant K is great in view of Equation (4). Consequently, in view of Equation (6), the secondary current $i_2$ becomes a large value because a component for compensating the decrease of the constant K flows in addition to a magnitude required for generating the torque T corresponding to the heavy load. The increase of the secondary current $i_2$ results in increase in the output current of the inverter. Since the inverter 29 is usually constructed of semiconductor elements such as transistors or thyristors, the increase of the current has led to the drawback that the capacities of the semiconductor elements are increased to render the inverter expensive.

SUMMARY OF THE INVENTION

This invention has been made in view of the drawback mentioned above, and has for its object to provide a velocity control apparatus for an elevator wherein an inverter is controlled by a velocity command signal so as to generate a three-phase alternating current of variable voltage and variable frequency and wherein a three-phase induction motor is driven by the three-phase alternating current; the load of the three-phase induction motor is detected by load detection means, and the voltage to be produced from the inverter is increased or decreased by the detected signal, whereby the output current of the inverter is rendered an appropriate one determined by the load of the three-phase induction motor, to suppress a rise in the cost of the inverter.

BRIEF DESCRIPTION OF THE DRAWINGS

FIGS. 2 and 3 show a prior-art velocity control apparatus for an elevator, in which FIG. 2 is a block diagram of the control circuit of the apparatus, while FIG. 3 is an explanatory diagram;

FIGS. 4 to 6 show an embodiment of this invention, in which FIG. 4 is a diagram corresponding to FIG. 2, FIG. 5 is a diagram corresponding to FIG. 3, and FIG. 6 is an explanatory diagram illustrative of torque variations with the operations of the elevator;

DESCRIPTION OF THE PREFERRED EMBODIMENTS

Figure 1:
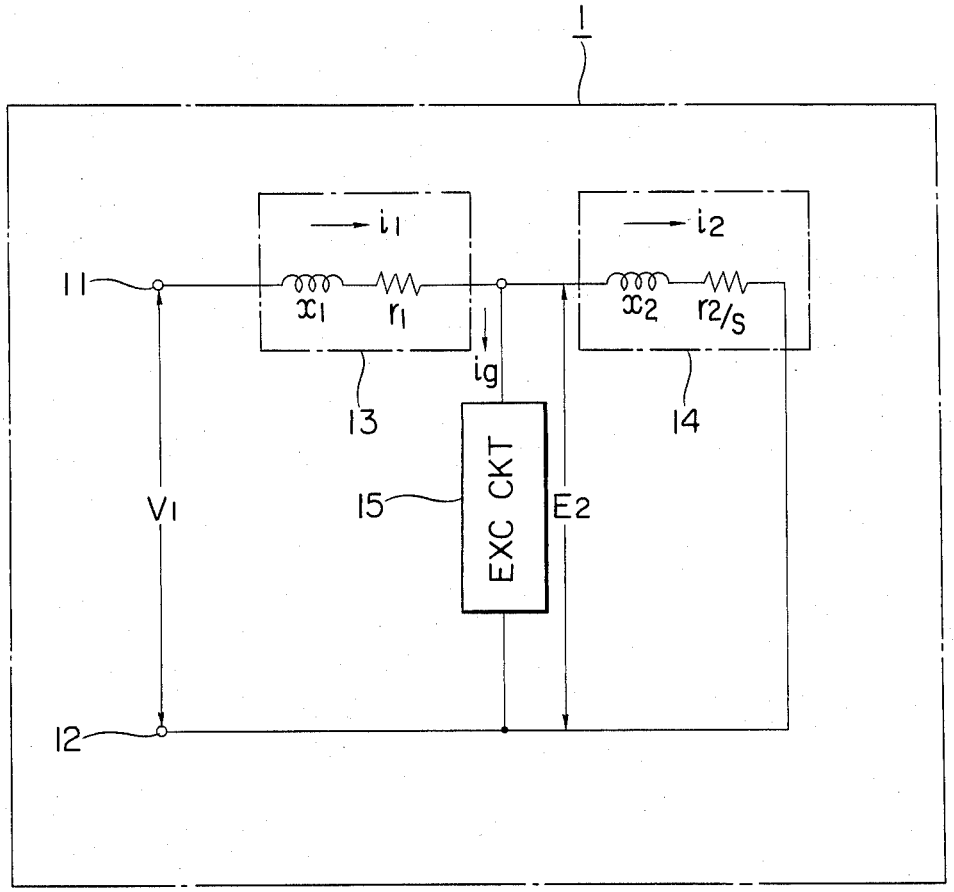
FIG. 1 is a circuit diagram of a three-phase induction motor.
Figure 2:
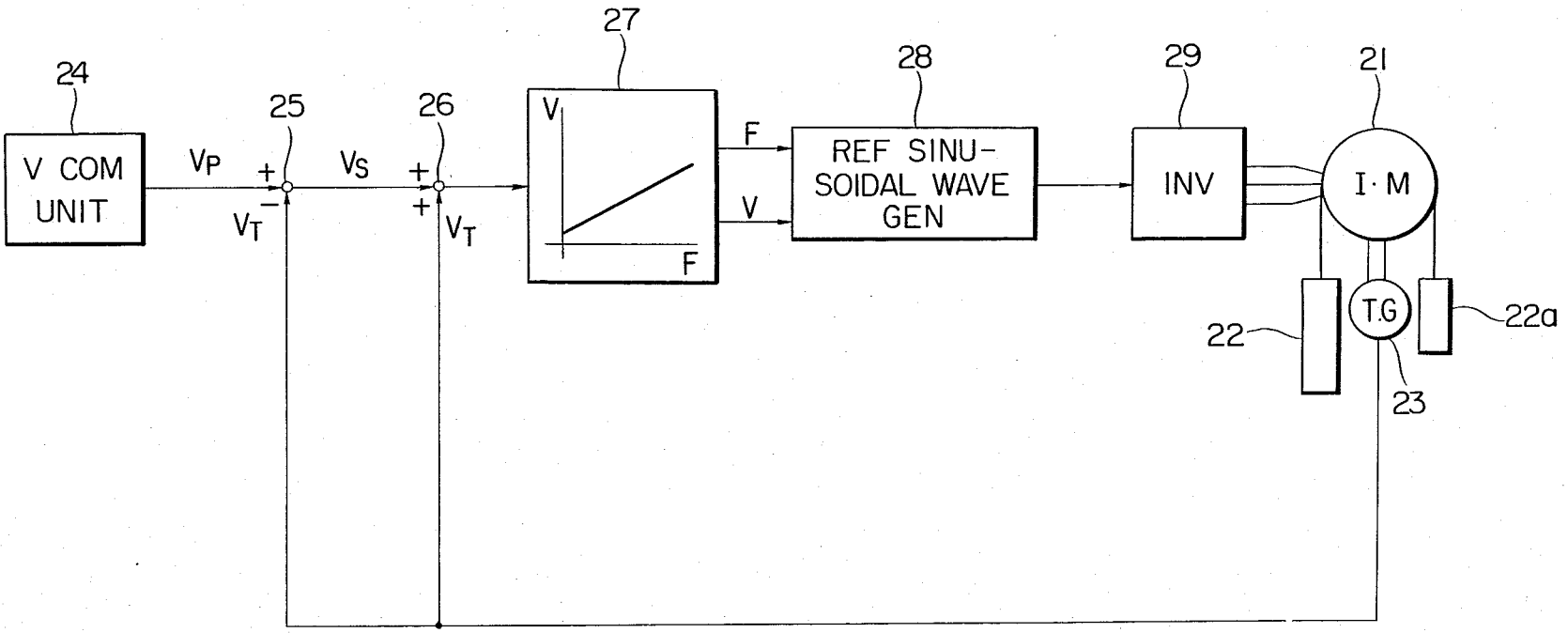
Figure 3:
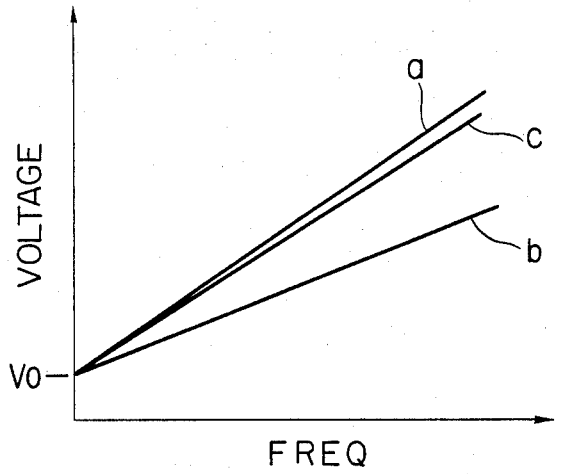
Figure 5:
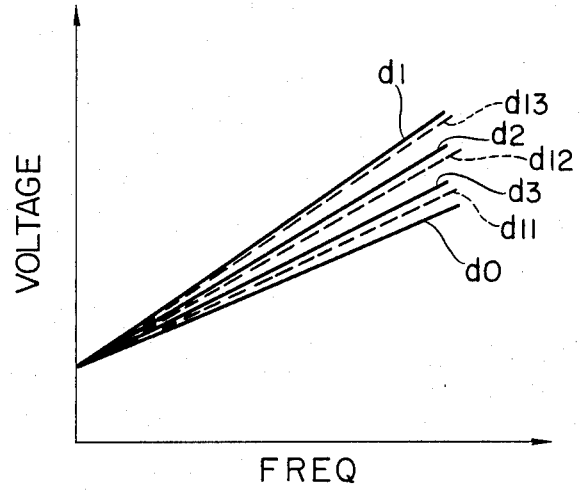
Figure 6:
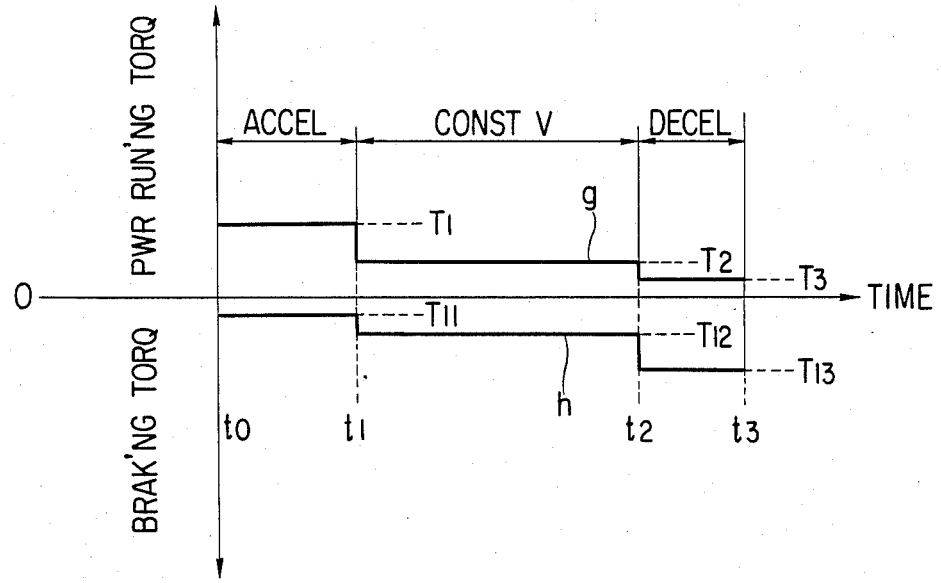
Figure 4:
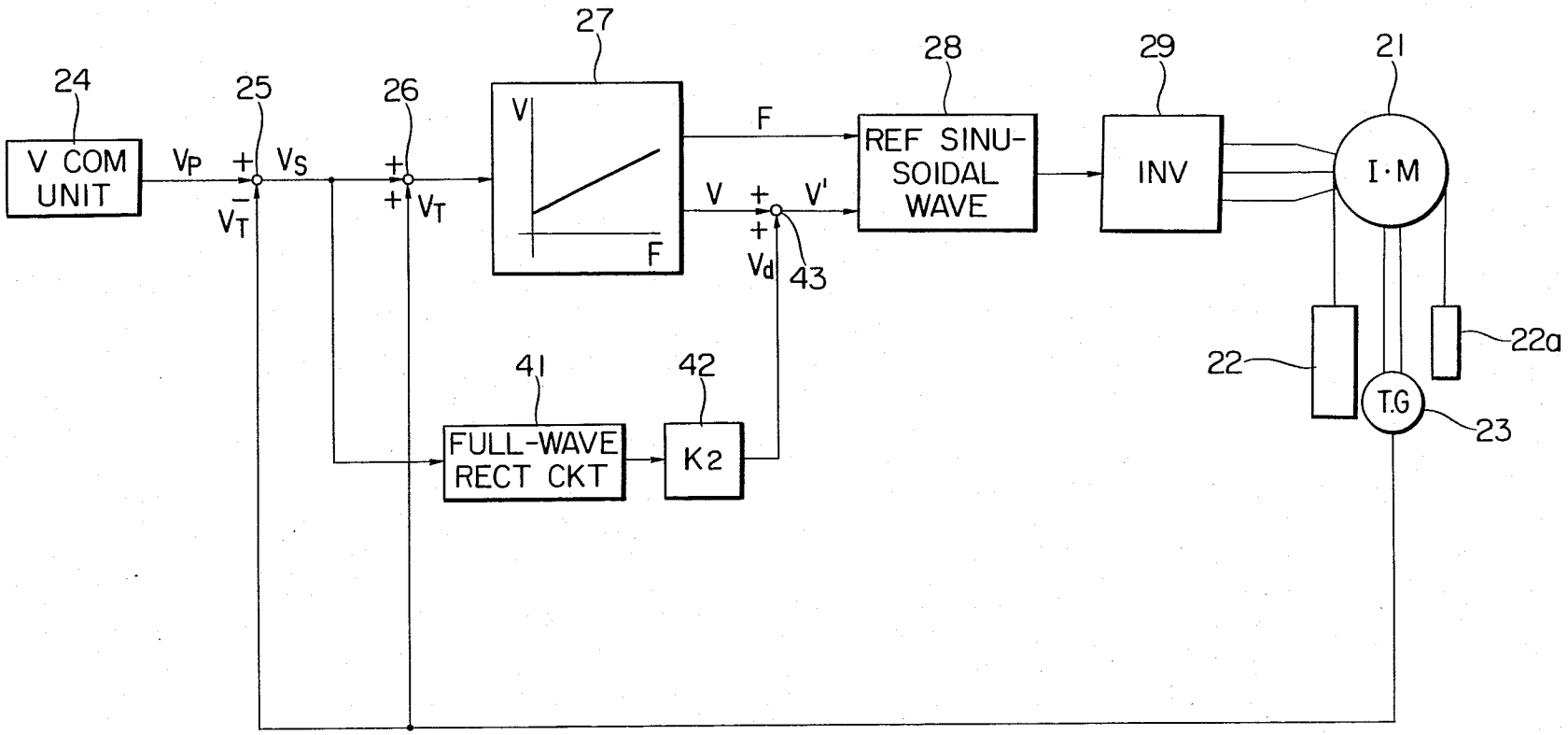

FIGS. 4 to 6 show one embodiment of this invention. In FIG. 4, numeral 41 designates a rectifier circuit which subjects the difference signal $V_S$ to full-wave rectification, numeral 42 a correction circuit which delivers a correction signal $V_d$ proportional to the output of the rectifier circuit 41, and numeral 43 an adder which adds the correction signal $V_d$ and the voltage command signal V of the function generator 27 so as to deliver a corrected voltage command signal V' and which applies the corrected voltage command signal V' to the reference sinusoidal wave generator 28.

Next, the operation of the embodiment will be described.

First, when the three-phase induction motor 21 has no load placed thereon, the velocity command signal $V_P$ becomes equal to the velocity signal $V_T$, and the difference signal $V_S$ becomes null. In consequence, the voltage command signal V of the function generator 27 is applied to the reference sinusoidal wave generator 28 without being corrected by the correction signal $V_d$, and the inverter 29 generates a three-phase alternating current having a voltage and frequency relation of a straight line ($d_O$) as shown in FIG. 5. Since the voltage drop across the primary winding 13 is small in the three-phase induction motor 21, the relation between the secondary induced voltage $E_2$ and the frequency $w_O$ as indicated by Equation (3) is substantially the same as the straight line ($d_O$) shown in FIG. 5.

Next, let it be supposed that the cage 22 is heavier than a balance weight 22*a*, so the three-phase induction motor 21 is subjected to a heavy load in order to raise the cage 22. The operation of the three-phase induction motor 21 from the starting to the stop thereof on this occasion is as illustrated by a curve (g) in FIG. 6. More specifically, the cage is accelerated during a period of time $t_O-t_1$, it is operated at a constant velocity during a period of time $t_1-t_2$, and it is decelerated during a period of time $t_2-t_3$. During the acceleration period, a torque $T_1$ indicated in FIG. 6 is required, and the velocity signal $V_T$ becomes smaller than the velocity command signal $V_P$, so that the difference signal $V_S$ becomes a plus value. This difference signal $V_S$ is rectified by the full-wave rectifier circuit 41, a plus signal is always applied to the correction circuit 42, and the voltage and frequency of a straight line ($d_1$) shown in FIG. 5 are provided from the inverter 29. Meanwhile, the primary current $i_1$ of large magnitude corresponding to the aforementioned torque $T_1$ flows through the three-phase induction motor 21, and a voltage drop is caused across the primary winding 13 by this primary current $i_1$, but the output voltage of the inverter 29 is high. As a result, therefore, the secondary induced voltage $E_2$ is related with the frequency $w_O$ just as the straight line ($d_O$) in FIG. 5 likewise to the cage of no load.

In the period of time $t_1-t_2$ during which the cage is ascending at the constant velocity, a power running torque $T_2$ is required. Since the difference signal $V_S$ on this occasion is smaller than the value in the acceleration mode, a voltage and frequency indicated by a straight line ($d_2$) shown in FIG. 5 are delivered from the inverter 29. Meanwhile, the voltage drop across the primary winding 13 becomes smaller than the value in the acceleration mode. Thus, the relation between the secondary induced voltage $E_2$ and the frequency $w_O$ becomes just as indicated by the straight line ($d_O$)in FIG. 5.

When the ascending cage 22 is decelerated, the three-phase induction motor 21 affords a torque $T_3$ which is still smaller than the torque in the constant-velocity ascent mode as illustrated in FIG. 6. Accordingly, the difference signal $V_S$ becomes a value smaller than at the constant velocity, and a voltage and frequency indicated by a straight line ($d_3$) in FIG. 5 are delivered from the inverter 29. Meanwhile, the voltage drop across the primary winding 13 becomes still smaller than at the constant velocity. Eventually, the relation between the secondary induced voltage $E_2$ and the frequency $w_O$ becomes that indicated by the straight line ($d_O$) in FIG. 5.

Hereinafter, there will be explained a case where the cage 22 heavier than the balance weight 22*a* is lowered. As illustrated in FIG. 6, the three-phase induction motor 21 generates a braking torque $T_{11}$ in the acceleration mode during the period of time $t_O-t_1$. The velocity signal $V_T$ becomes a value larger than that of the velocity command signal $V_P$, and the difference signal $V_S$ becomes a minus value. This difference signal $V_S$ is rectified by the full-wave rectifier circuit 41, a plus signal is applied to the correction circuit 42, and the voltage and frequency of a straight line ($d_{11}$) shown in FIG. 5 are delivered from the inverter 29. Meanwhile, the primary current $i_1$ corresponding to the braking torque $T_{11}$ flows through the three-phase induction motor 21, and a voltage drop is caused across the primary winding 13 by this primary current $i_1$. Eventually, however, the secondary induced voltage $E_2$ is related with the frequency $w_O$ as the straight line ($d_O$) in FIG. 5 likewise to the case of no load.

Similarly, in the constant velocity and deceleration regions, torques $T_{12}$ and $T_{13}$ are generated as shown in FIG. 6, the voltage command signals V are corrected by the correction signals $V_d$ proportional to the absolute values of the difference signals $V_S$ between the velocity signals $V_T$ and the velocity command signals $V_P$, and the three-phase alternating currents of voltages and frequencies related as indicated by straight lines ($d_{12}$) and ($d_{13}$) in FIG. 5 are produced from the inverter 29, respectively. A voltage drop develops across the primary winding 13 in the three-phase induction motor 21, and eventually, the relation between the secondary induced voltage $E_2$ and the frequency $w_O$ becomes just as the straight line ($d_O$) in FIG. 5.

According to the above embodiment, the difference between the velocity command signal $V_P$ and the velocity signal $V_T$ is detected, and the voltage command signal V based on the velocity command signal $V_P$ is corrected by adding thereto the correction signal $V_d$ which is obtained from the absolute value of the difference, so that the ratio between the secondary induced voltage and the frequency of the three-phase induction motor becomes constant, and the torque becomes a value proportional to the secondary current. Accordingly, even when a great torque acts on the three-phase induction motor, the increment of the primary current becomes corresponding to the increment of the torque, and any current for compensating the drop of the secondary induced voltage does not arise. For this reason, the current capacity of the inverter is allowed to be small.

Figure 7:
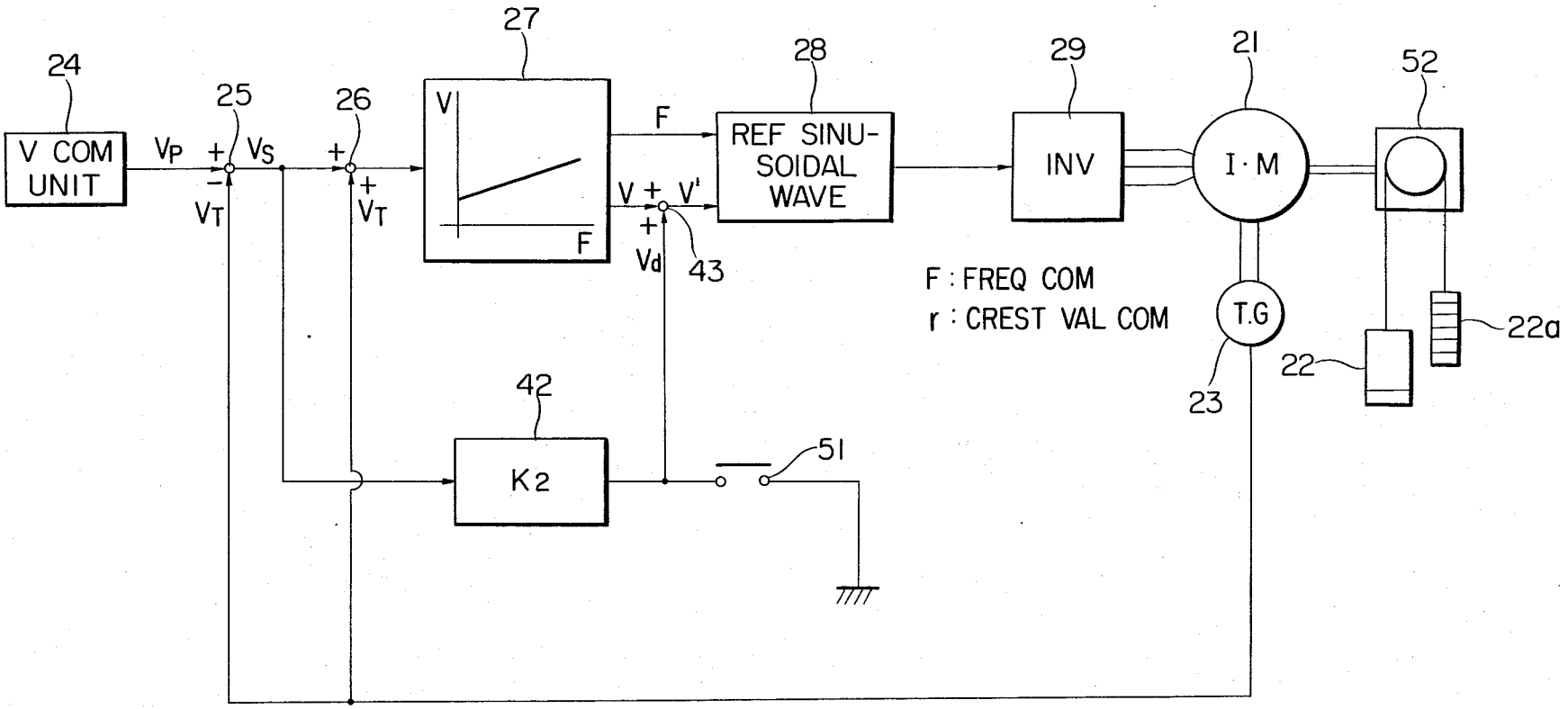
FIG. 7 diagram corresponding to FIG. 2, which shows another embodiment of this invention.

FIG. 7 shows another embodiment of this invention. Since the elevator has the cage 22 and the balance weight 22*a* suspended in a well-bucket fashion, both the power running torque and the braking torque are generated in the three-phase induction motor 21 as illustrated in FIG. 6. In this regard, in a gear type elevator which employs a reduction gear 52, a loss in the reduction gear 52 is heavy, and hence, the power running toruqe is generated throughout the acceleration mode. On the other hand, the deceleration torque becomes a very small value. Therefore, the deceleration torque need not be corrected. Upon commencement of the deceleration, a contact 51 is closed to ground the correction circuit 42, thereby to invalidate the correction signal $V_d$. When the correction signal $V_d$ is invalidated, the voltage and frequency indicated by the straight line ($d_O$) in FIG. 5 are delivered from the inverter. The voltage command signal V is corrected as in the embodiment shown in FIG. 4 in accordance with a load exerted on the three-phase induction motor 21, and the relation between the output voltage and frequency from the inverter 29 changes to become as illustrated in FIG. 5.

According to the embodiment shown in FIG. 7, the voltage command signal V can be corrected by the correction circuit 42 and the adder 43, and the intended purpose can be achieved. The embodiment also has the advantage of a simplified circuit arrangement.

While, in the foregoing embodiments, the tachometer generator has been employed as the load detection means, it may well be replaced with a weighting device which directly detects a load on the cage or a current detecting device which detects the current of the three-phase induction motor.

As set forth above, according to this invention, in a velocity control apparatus for an elevator wherein an inverter is controlled by a velocity command signal to generate a three-phase alternating current of variable voltage and variable frequency and wherein a three-phase induction motor is driven by the three-phase alternating current, a load acting on the three-phase induction motor is detected by load detection means, and a correction circuit is disposed by which the voltage to be produced from the inverter is increased or decreased in accordance with the detected signal, so that the output current of the inverter becomes proportional to the increase or decrease of the load of the three-phase induction motor, and an extremely large current does not flow. Therefore, the inverter may have a proper capacity determined by the load of the three-phase induction motor, which brings forth the effect that a rise in the cost of the inverter can be suppressed.

Now, the principal circuits in the control apparatus of each of the embodiments shown in FIGS. 4 and 7 will be described in detail.

Figure 8:
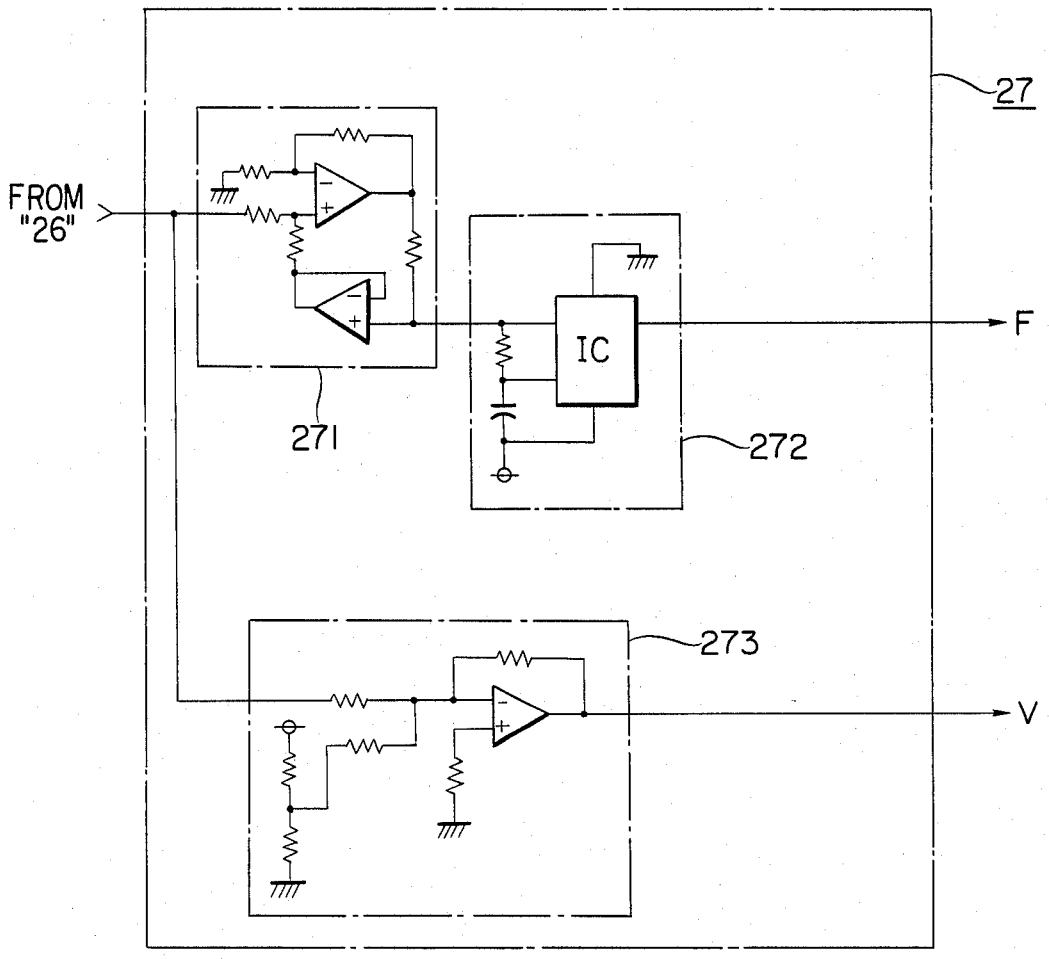
FIG. 8 is a circuit diagram showing the details of a function generator.

FIG. 8 shows the function generator 27. Referring to the Fig., voltage-to-current converter circuit 271 receives the output signal of the adder 26, and delivers a current dependent upon the signal. A current-to-pulse train converter circuit 272 receives the output of the converter circuit 271, and generates a pulse train which has a frequency proportional to the received input current. An IC used in the converter circuit 272 is an IC for a timer, and it may be, for example, an IC "M51841P" manufactured by Mitsubishi Electric Corporation. A voltage command generator circuit 273 receives the output signal of the adder 26, and delivers a voltage signal which is rectilinearly proportional to the received signal. The signals F and V are generated by such a function generator 27.

Figure 9:
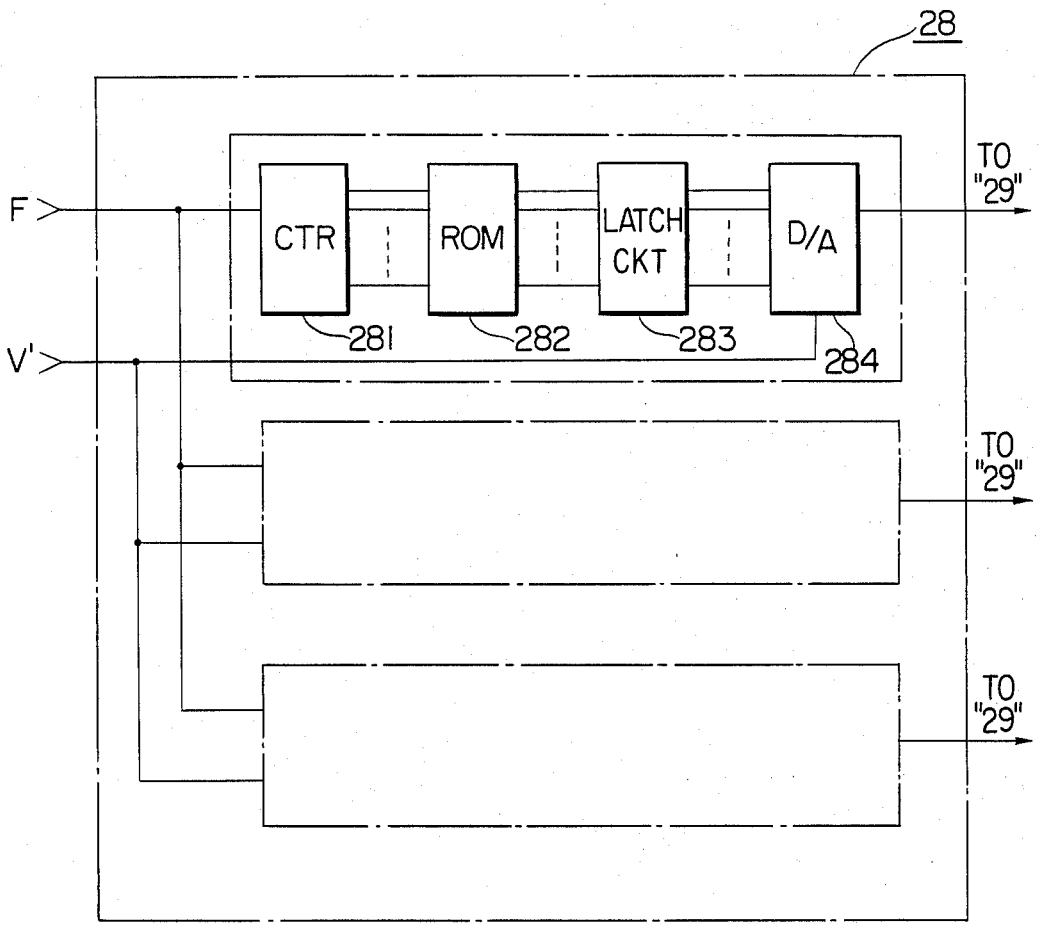
FIG. 9 is a circuit diagram showing the details of a reference sinusoidal wave generator.

FIG. 9 shows the reference sinusoidal wave generator 28. The input signal F being the pulse train is applied to a counter 281, which converts it into a digital signal. The digital signal is applied to the address pins of a ROM 282, to read out the sinusoidal wave data of a corresponding address stored in the ROM 282. The read-out data is latched by a latch circuit 283, the output of which is converted into an analog voltage by a digital-to-analog converter 284. This voltage signal is supplied to the inverter 29.

The amplitude of the output of the digital-to-analog converter 284 changes depending upon the input signal V'.

Two other circuits as described above are disposed, so as to produce reference sinusoidal waves corresponding to three phases.

Figure 10:
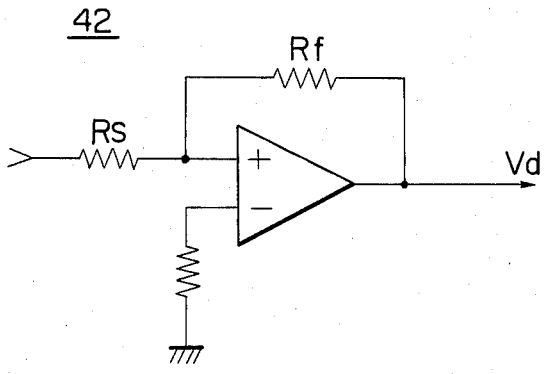
FIG. 10 is a circuit diagram showing the details of a correction circuit.

FIG. 10 shows the correction circuit 42. It receives a signal which is based on the difference between the velocity command signal $V_P$ and the velocity signal $V_T$. In accordance with a constant which is determined by resistances $R_s$ and $R_f$, the correction circuit corrects the received signal to deliver the corrected signal $V_d$.

That is, the correction circuit 42 generates the output signal by operating the output $V_d = \text{input} \times (-R_f/R_s)$.

What is claimed is:

1. In an elevator having an inverter which generates a three-phase alternating current of variable voltage and variable frequency, a velocity command signal generator which produces a velocity command signal for controlling the inverter, and a three-phase induction motor driven by the generated three-phase alternating current from the inverter so as to run a cage, velocity control apparatus for the elevator comprising:

(a) detection means for detecting a load on said three-phase induction motor and for producing a detection signal;

(b) voltage command signal generation means including means for comparing the detection signal and the velocity command signal and means for supplying the inverter with at least a voltage command signal on the basis of a difference signal resulting from the comparison; and (c) correction means for adjusting the voltage command signal supplied by said voltage command signal generation means on the basis of the difference signal resulting from the comparison between the detection signal of said detection means and the velocity signal so as to deliver a voltage command signal corrected for variations in load for varying and controlling the alternating current generated by the inverter for running the cage.

2. A velocity control apparatus for an elevator as defined in claim 1 wherein said load detection means is a velocity detector which detects a velocity of said induction motor, and said correction means generates a correction signal on the basis of a difference signal obtained by comparing the velocity detection signal of said velocity detector and said velocity command signal.

3. A velocity control apparatus for an elevator as defined in claim 2 wherein said correction means performs a correcting operation by adding a correction signal generated therein to the voltage command delivered

4. A velocity control apparatus for an elevator as defined in claim 1 wherein said correction means delivers a correction signal having a magnitude varying with the difference signal produced by comparing the load detection signal and the velocity command signal.

5. In an elevator having an inverter which generates a three-phase alternating current of variable voltage and variable frequency, a velocity command signal generator which produces a velocity command signal for controlling the inverter, and a three-phase induction motor driven by the generated three-phase alternating current from the inverter so as to run a cage, a velocity control apparatus for the elevator comprising:

(a) detection means including a velocity detector for detecting velocity of the three-phase induction motor and for producing a detection signal;

(b) voltage command signal generation means including means for comparing the detection signal and the velocity command signal and means for supplying the inverter with at least a voltage command signal on the basis of a difference signal resulting from the comparison; and (c) correction means for adjusting the voltage command signal supplied by said voltage command signal generation means on the basis of the difference signal resulting from the comparison between the detection signal of said detection means and the velocity command signal so as to deliver a voltage command signal corrected for variations in load for varying and controlling the alternating current generated by the inverter for running the cage, said correction means receiving an absolute value of the difference signal.

6. A velocity control apparatus for an elevator as defined in claim 5, wherein said difference signal is applied to said correction means through full-wave rectification means for subjecting the input signal to full-wave rectification.

7. In an elevator having an inverter which generates a three-phase alternating current of variable voltage and variable frequency, a velocity command signal generator which produces a velocity command signal for controlling the inverter, and a three-phase induction motor driven by the generated three-phase alternating current from the inverter so as to run a cage, a velocity control apparatus for the elevator comprising:

(a) detection means including a velocity detector for detecting velocity of the three-phase induction motor and for producing a detection signal:

(b) voltage command signal generation means including means for comparing the detection signal and the velocity command signal and means for supplying the inverter with at least a voltage command signal on the basis of a difference signal resulting from the comparison;

(c) correction means for adjusting the voltage command signal supplied by said voltage command signal generation means on the basis of the absolute value of the difference signal resulting from the comparison between the detection signal of said detection means and the velocity command signal so as to deliver a voltage command signal corrected for variations in load and having a magnitude varying with the difference signal; and (d) means for supplying the corrected voltage command signal for varying and controlling the alternating current generated by the inverter in both a power running operation and a braking operation of the motor.

8. A velocity control apparatus for an elevator as defined in claim 7, wherein said switching means has a contact which executes a switching operation when a deceleration operation of said elevator has been detected.

9. A velocity control apparatus for an elevator as defined in claim 8 wherein said contact is disposed between an output terminal of said correction means and the earth terminal, and said contact is closed to interrupt the corrected voltage command signal during the deceleration.

10. In an elevator having an inverter which generates a three-phase alternating current of variable voltage and variable frequency, a velocity command signal generator which produces a velocity command signal for controlling the inverter, and a three-phase induction motor driven by the generated three-phase alternating current from the inverter so as to run a cage, a velocity control apparatus for the elevator comprising:

(a) detection means including a velocity detector for detecting velocity of the three-phase induction motor and for producing a detection signal;

(b) voltage command signal generation means including means for comparing the detection signal and the velocity command signal and means for supplying the inverter with at least a voltage command signal on the basis of a difference signal resulting from the comparison;

(c) correction means for adjusting the voltage command signal supplied by said voltage command signal generation means on the basis of the difference signal resulting from the comparison between the detection signal of said detection means and the velocity command signal so as to deliver a voltage command signal corrected for variations in load for varying and controlling the alternating current generated by the inverter for running the cage; and (d) switching means for supplying the corrected voltage command signal resulting from said correction means to the inverter only in a power running operation of the induction motor.

* * * * *